US006176214B1

(12) United States Patent
Yamaguchi

(10) Patent No.: US 6,176,214 B1
(45) Date of Patent: Jan. 23, 2001

(54) LUBRICATING STRUCTURE FOR INTERNAL COMBUSTION ENGINE

(75) Inventor: Masashi Yamaguchi, Yokohama (JP)

(73) Assignee: Nissan Motor Co., Ltd., Yokohama (JP)

( * ) Notice: Under 35 U.S.C. 154(b), the term of this patent shall be extended for 0 days.

(21) Appl. No.: 09/386,275

(22) Filed: Aug. 31, 1999

(30) Foreign Application Priority Data

Sep. 4, 1998 (JP) ..... 10-250986

(51) Int. Cl.[7] ..... F01M 1/06
(52) U.S. Cl. ..... 123/196 R
(58) Field of Search ..... 123/196 R, 41.38, 123/41.35; 184/6.5

(56) References Cited

U.S. PATENT DOCUMENTS 3,785,459 * 1/1974 Patchen ..... 184/6.5
3,842,938 * 10/1974 Barnes-Moss ..... 184/6.5
5,039,285 * 8/1991 Lindstrom ..... 184/6.8
5,174,249 * 12/1992 Katou ..... 123/41.38
5,533,472 * 7/1996 Sands et al. ..... 123/41.35

FOREIGN PATENT DOCUMENTS 26 47 441 * 10/1976 (DE) ..... 184/6.5
116092 * 10/1942 (GB) ..... 123/41.38

* cited by examiner

*Primary Examiner*—Willis R. Wolfe
*Assistant Examiner*—Hyder Ali
(74) *Attorney, Agent, or Firm*—Foley & Lardner

(57) ABSTRACT

A lubricating structure for an internal combustion engine is provided to improve the structure's lubricating ability on an inner face of each cylinder liner and reduce the piston slap. For each cylinder of the engine, when the position of a splash oil hole 15 of a pin journal coincides with the position of an oil hole 13 of a crank pin 5, the position of an oil hole 11 of a main journal 1 coincides the position of an oil hole 12 of a crankshaft 4, while the splash oil hole 15 directs itself toward the inner peripheral face of the cylinder liner 16.

6 Claims, 3 Drawing Sheets

LUBRICATING STRUCTURE FOR INTERNAL COMBUSTION ENGINE

BACKGROUND OF THE INVENTION

1. Field of the Invention

The present invention relates to a lubricating structure for an internal combustion engine and, more particularly, to an improvement of lubricating ability on an inner face of a cylinder liner.

2. Description of the Related Art

Generally, lubricating oil in the internal combustion engine is sucked up from an oil pan through the intermediary of a strainer by an oil pump. Thereafter, the pressure of lubricating oil is controlled by a pressure governor and subsequently, the oil is fed to a main gallery. Formed to branch off from the main gallery are respective oil holes (or lubricant passages) through which the lubricating oil is supplied to respective lubricating sections, for example, a moving valve system, the crankshaft and so on.

Hereat, the lubricating oil for each lubricating section of the crankshaft is firstly fed from the main gallery to a main journal and sequentially fed to a pin journal through an oil hole (passage) penetrating both crankshaft and crank pin and finally reaching the crank pin. Thereafter, the lubricating oil is drained into an oil pan through a clearance between the main journal and the crankshaft and another clearance between the pin journal and the crank pin. While, the lubricating oil brought to each pin journal passes through a splash oil hole having one end opening at the inner face of a circular hole for bearing the crank pin of the pin journal and the other end opening at a base of a connecting-rod as a lubricant injection nozzle. Next, on completion of the piston lubrication, the lubricating oil is returned to the oil pan.

Here, regarding the formation of both splash oil hole of the connecting-rod and oil hole penetrating the crankshaft for the pin journal, there is a known lubricating structure where the arrangement of both holes are established such that, when the position of the former oil hole coincides with the position of the latter hole, then the lubricating oil ejected from the splash oil hole is supplied against the inner face of the cylinder liner (see Japanese Unexamined Patent Publication No. 9-280027).

However, since the above-mentioned earlier art has been provided on only consideration to coincide the position of the splash oil hole with the position of the oil hole of the pin journal when the splash oil hole faces to the inner face of the cylinder liner, there is not defined a positional relationship between the oil hole in the main journal communicating with the main gallery and the oil hole formed in the crankshaft. That is, even when the position of the splash oil hole agrees with the position of the oil hole of the pin journal, the position of the oil hole on the main journal's side does not coincide with that of the oil hole formed in the crankshaft.

Therefore, the lubricating oil, which has been supplied from the oil hole of the main journal at the positional incidence between the splash oil hole and the oil hole of the pin journal, is introduced into the oil hole of the crankshaft through a groove section between the crankshaft and the main journal.

In such a lubricating route, due to a great reduction in lubricant pressure at the groove section between the crankshaft and the main journal, it is not possible to ensure a sufficient amount of lubricant ejected from the splash oil hole via the oil hole of the crankshaft and the sequential oil hole of the crank pin. Especially, since the lubrication on the inner face of the cylinder liner is insufficient at the vehicle's cold starting, the earlier art lubricating structure cannot perform sufficient effect to reduce the piston slap.

SUMMARY OF THE INVENTION

Under such a circumstance, it is an object of the present invention to improve the structure's lubricating ability on the inner face of the cylinder liner in order to reduce the piston slap, together with the oil hole arrangement where the lubricant route from the main gallery up to the splash oil hole via the main journal, the crankshaft and the crank pin is constructed just like a single oil passage.

According to the invention, the above-mentioned object is accomplished by a lubricating structure for an internal combustion engine, comprising:

- a first oil hole formed in a main journal to communicate with a main gallery provided in a cylinder block;
- a crankshaft having a second oil hole formed so as to communicate with the first oil hole of the main journal;
- at least one crank pin formed on the crankshaft to rotate about a center of the crankshaft, the crank pin having a third oil hole formed for communication with the second oil hole of the crank shaft;
- a connecting-rod rotatably fitted on the crank pin and also provided, at a base part thereof, with a splash oil hole which is constructed so as to communicate with the third oil hole of the crank pin and which has an end opening at an inner face of a circular inner face of a bore for bearing the crank pin and the other end opening at the base part of the connecting-rod as an ejecting port for lubricating oil;
- wherein the first, second and third oil holes and the splash oil hole are constructed so that, when the position of the splash oil hole coincides with the position of the third oil hole, the position of the first oil hole coincides the position of the second oil hole while the splash oil hole directs itself toward an inner peripheral face of a cylinder liner.

Providing that, in view of the axial direction of the crankshaft,

- $\alpha$ represents an angle in a rotating direction of the crankshaft, the angle being made by both of an extension line on the side of the crank pin of a line linking a center of the crankshaft with a center of the crank pin and a line linking the center of the crank pin with an opening of the third oil hole opening at the outer face of the crank pin;
- $\beta$ represents an angle between a center line of the connecting-rod and a line linking the center of the crank pin with the opening of the splash oil hole on the side of the inner face of the pin journal, in the opposite direction of the rotating direction of the crankshaft;
- $\gamma$ represents an angle between the line linking the center of the crankshaft with the center of the crank pin center and a line linking the center of the crankshaft with an opening of the second oil hole opening at the outer face of the crankshaft, in the rotating direction of the crankshaft;
- r represents a distance between the center of the crankshaft and the center of the crank pin;
- l represents a distance between respective rotating centers on both sides of the connecting-rod; and
- $\tau$ represents an angle between a cylinder bore's center line passing through a center of the main journal and a line linking the center of the crankshaft with the opening of the first oil hole at the inner face of the main journal, in the rotating direction of the crankshaft, it is preferable that respective positions of the first, second and third oil holes and the splash oil hole are determined so as to meet a relationship of:

$$\gamma = \tau - \tan^{-1}\left\{\frac{-\sin(\alpha+\beta)}{(r/l)+\cos(\alpha+\beta)}\right\}$$

The above and other features and advantages of this invention will become apparent, and the invention itself will best be understood, from a study of the following description and appended claims, with reference to the attached drawings showing one preferred embodiment of the invention.

DESCRIPTION OF THE PREFERRED EMBODIMENT

Referring to the attached drawings, we now describe two embodiments of he present invention.

Figure 1:
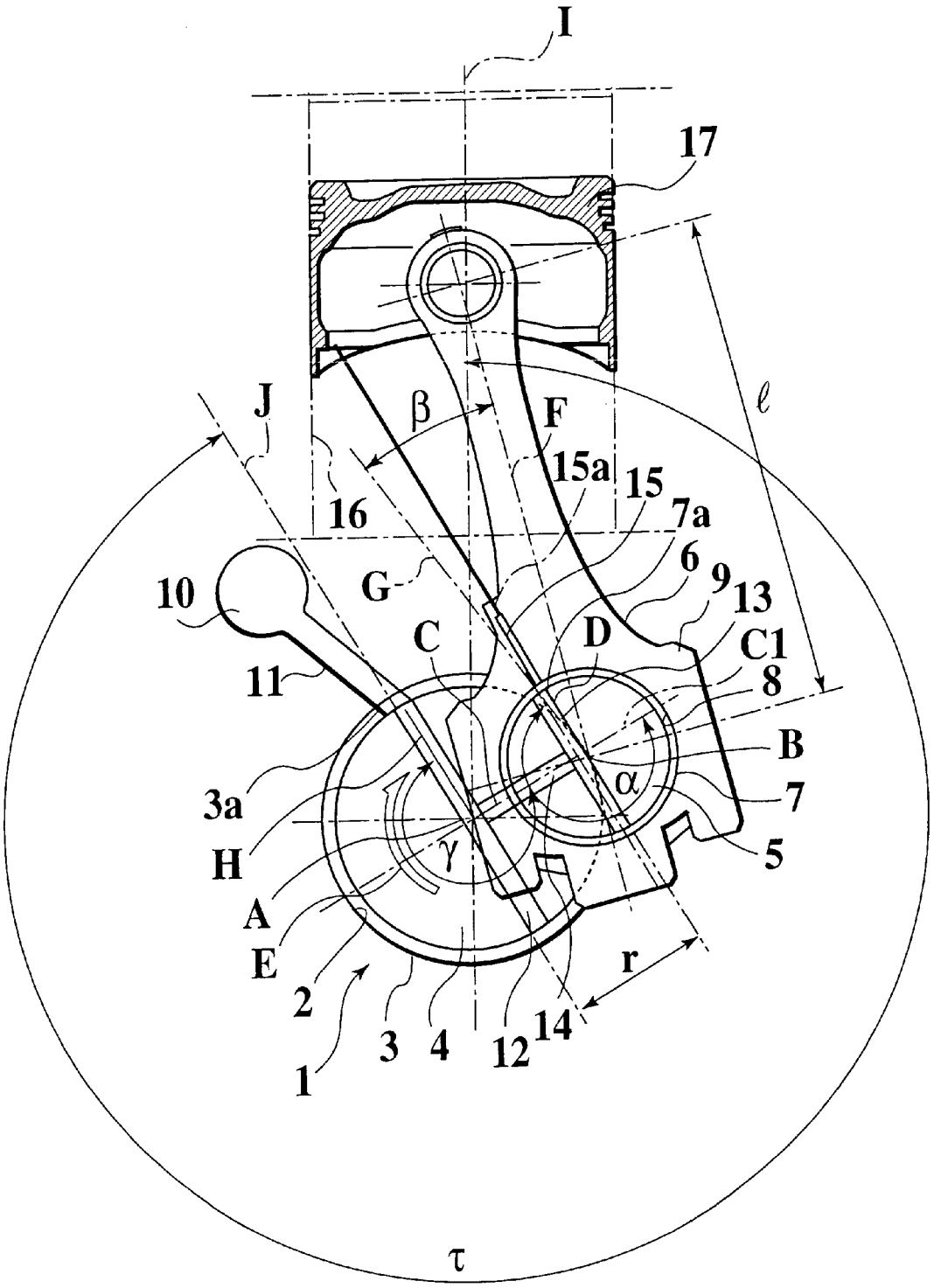
FIG. 1 is a cross sectional view of an essential part of the lubricating structure for an internal combustion engine, in accordance with one embodiment of the present invention, also showing a piston between the top dead center and the bottom dead center.

FIG. 1 is a cross sectional view of an essential part of the lubricating structure for an internal combustion engine, in accordance with the first embodiment of the present invention, also showing a piston between the top dead center and the bottom dead center.

In the figure, a main journal 1 is provided with a circular bore 2 in which a crankshaft 4 is rotatably fitted through a main metal 3. Connected to the crankshaft 4 is a crank pin 5 which rotates about the center of the crankshaft 4 as the rotating center. The base bottom of the connecting-rod 6 is constituted by a pin journal 9 provided with a circular bore 8 for bearing the crank pin 5 through the intermediary of a pin metal 7.

Thus, the reciprocating motion of the connecting-rod 6 is converted into the rotating motion of the crankshaft 4 through the crank pin 5.

The main journal 1 has a first oil hole (lubricating passage) 11 formed for communication with the main gallery 10 of a cylinder block.

On the other hand, the crankshaft 4 has a second oil through-hole (lubricating passage) 12 formed so as to communicate with the oil hole 11 on the side of the main journal 1 through a lubrication port 3 a formed in the main metal 3. The oil through-hole 12 is also formed so as to open at opposite positions on the crankshaft 4 and pass in the vicinity of the center axis of the crankshaft 4.

Similarly, the crank pin 5 has a third oil hole (lubricating passage) 13 formed so as to open at opposite positions on the outer face of the pin 5 and pass in the vicinity of the center axis of the crank pin 5.

These oil holes 12, 13 are communicated with each other through an oil hole 14 formed in both crankshaft 4 and crank pin 5.

In this case, the oil hole 14 is formed so as to diverge from the oil hole 12 at the vicinity of the center axis of the crankshaft 4 and reach the oil hole 13 at the vicinity of the center axis of the crank pin 5.

While, the pin journal 9 is provided with an oil hole 15 which can communicate with the oil hole 13 in the crank pin 5. The oil hole (splash oil hole) 15 has one end communicating with a lubricating port 7*a* formed in the pin metal 7 bearing the crank pin 5 and the other end opening at an upper face of the base of the connecting-rod 6 and being defined as a lubricant injection port 15*a* directing itself to the inner face of a cylinder liner 16 in the cylinder block.

Note, in this drawing, reference numeral 17 denotes a piston.

In the above-mentioned constitution, the lubricant supply for the oil hole 12 in the crankshaft 4 is carried out from the main gallery 10 through the oil hole 12 of the main journal 1 and the lubricating port 3*a* of the main metal 3 in order.

As described above, since the oil hole 12 of the crankshaft 4 communicates with the oil hole 13 of the crank pin 5, the lubricating oil can be supplied from the crank shaft 4 to the crank pin 5.

Meanwhile, the lubricating oil discharged from the oil hole 13 of the crank pin 5 is ejected from the splash oil hole 15 at the opportunity when the oil hole 12 coincides with the splash oil hole 15. In this regards, the splash oil hole 15 is positioned in such a manner that the splash oil hole 15 looks toward the inner circumferential face of the cylinder liner 16 in the cylinder block at the time of the above coincidence between the oil hole 12 and the splash oil hole 15. Consequently, the lubricating oil ejected from the splash oil hole 15 can be ejected toward the inner face of the cylinder liner 16.

In this way, the lubricant supply to the cylinder liner 16 allows an oil film to be formed between the cylinder liner 16 and the piston 17, thereby effecting a reduction of slap noise.

Hereat, according to the invention, respective oil holes extending from the main galley 10 up to the splash oil hole 15 of the pin journal 9 via the main journal 1, the crankshaft 4 and the crank pin 5 in order, are positioned as if they were a single oil passage, in order to ensure a sufficient amount of lubricating oil ejected toward the cylinder liner 16.

That is, the lubricating structure of the invention is constructed in a manner that when the splash oil hole 15 coincides with the oil hole 13 of the crank pin 5, then the oil hole 11 on the side of the main journal 1 simultaneously coincides with the oil hole 12 of the crankshaft 4 while the splash oil hole 15 looks toward the inner circumferential face of the cylinder liner 16.

Note, regarding the positional establishment of the above oil holes, an overlap angle between the adjacent oil holes may be acceptable as a tolerance.

We now describe how to establish the respective positions of the respective oil holes for realizing the above-mentioned structure, as follows.

That is, when $\alpha$ represents an angle in a rotating direction E of the crankshaft 4, the angle being made by both of an extension line C1 (on the side of the crank pin) of a line C linking a center A of the crankshaft with a center B of the crank pin and a line D linking the center B with the opening of the oil hole 13 at the outer face of the crank pin 5;

$\beta$ an angle between a center line F of the connecting-rod 6 and a line G linking the center B of the crank pin with the opening of the splash oil hole 15 on the side of the inner face of the pin journal 9, in the opposite direction of the direction E;

γ an angle between the line C linking the crankshaft center A with the crank pin center B and a line H linking the center A with the opening of the oil hole 12 at the outer face of the crankshaft 4, in the rotating direction E;

(r) a distance between the center A and the center B;

(l) a distance between rotating centers on both sides of the connecting-rod 6; and τ represents an angle between a cylinder bore's center line I passing through a center of the main journal (i.e. the center A) and a line J linking the center A with the opening of the oil hole 11 at the inner face of the main journal 1, in the rotating direction E, respective positions of the oil holes are determined so as to meet the following relationship:

$$\gamma = \tau - \tan^{-1}\left\{\frac{-\sin(\alpha+\beta)}{(r/l)+\cos(\alpha+\beta)}\right\}$$

By determining the respective positions of the oil holes on the ground of the above expression, the time when the position of the splash oil hole 15 coincides with the position of the oil hole 13 of the crank pin agrees with the time when the position of the oil hole 11 of the main journal 1 coincides with the position of the oil hole 12 of the crankshaft 4, so that it can be obtained a condition that the main gallery 10 communicates with the splash oil hole 15. Consequently, high oil pressure (e.g. approx. 5 kgf/cm$^2$) in the main gallery 10 is directly applied on the splash oil hole 15, so that an amount of lubricant ejected from the splash oil hole 15 is remarkably increased at the engine's driving at low speed in the cold. Thus, it is possible to improve the reduction of piston slapping at the vehicle's cold starting remarkably.

In this case, owing to the establishment of the respective oil holes by the numerical formula, it is possible to carry out the optimization of respective oil holes with ease.

Although, in the above-mentioned embodiment, the present invention is applied to a H-shaped lubricating structure where the oil hole 12 of the crankshaft 4 and the oil hole 13 of the crank pin 5 are arranged in parallel with each other while respective intermediate portions of the oil holes 12, 13 are communicated with each other through the oil hole 14 perpendicular to the holes 12, 13, the invention is also applicable to an oblique lubricant structure where the oil hole on the crankshaft's side is constituted by a first oil hole capable of communicating with the oil hole of the crank pin in a straight manner and a second oil hole having one end communicating with the first oil hole and the other end opening at the outer peripheral face of the crankshaft and further communicating with the oil hole on the main journal's side.

Note, this oblique lubricating structure has the advantage of simple oil holes' configuration and therefore, it is excellent in forming the oil holes.

Figure 2:
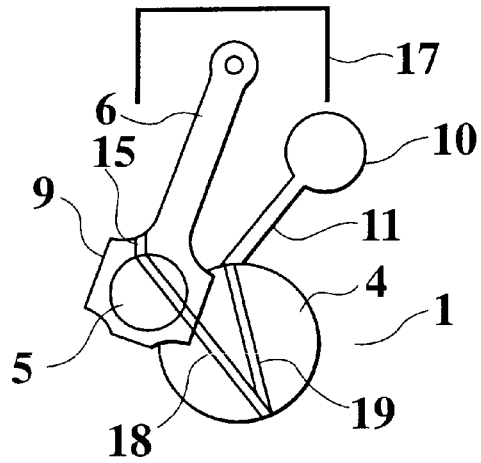
FIG. 2 is a schematic sectional view showing another embodiment of the invention.

The detailed oblique lubricating structure will be described with reference to FIG. 2. In the structure, an oil hole 18 is formed so as to penetrate both crankshaft 4 and crank pin 5 in a straight manner and also pass the vicinities of respective center axes thereof, providing the oil hole of the crank pin 5 and the above first oil hole of the crankshaft 4.

While, the crankshaft 4 has the second oil hole 19 having one end communicating with the opening of the oil hole 18 at the outer face of the crankshaft 4 and the other end opening at the outer face of the crankshaft 4 and further communicating with the oil hole 11 of the main journal 1.

According to the structure, the lubricating oil is supplied from the oil hole 11 of the main journal 1 to the second oil hole 19 of the crankshaft 4 via a not-shown lubrication orifice in the main metal.

As described above, since the second oil hole 19 on the crankshaft's side communicates with the oil hole 18 penetrating the crankshaft 4 and the crank pin 5, the lubricating oil is successively supplied from the second oil hole 19 to the crank pin 5.

Further, also in the oblique lubricating structure, the lubricating oil disgorged from the oil hole 18 is ejected from the splash oil hole 15 when the former coincides with the latter. In connection, by positioning the splash oil hole 15 so as to direct itself to the inner face of the cylinder liner at the coincidence between the holes 18 and 15, it is possible to allow the lubricating oil to be ejected from the splash oil hole 15 toward the inner face of the cylinder liner.

Figure 3:
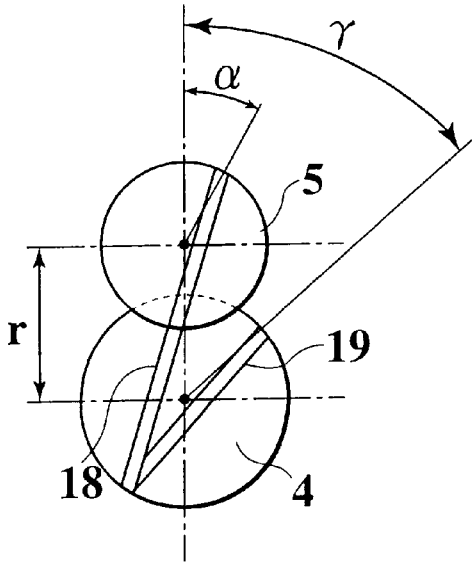
FIG. 3 is a schematic view showing a crankshaft and a crank pin of the embodiment of FIG. 2.
Figure 4:
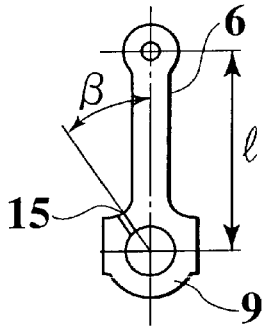
FIG. 4 is a schematic view showing a connecting-rod of the embodiment of FIG. 2.
Figure 5:
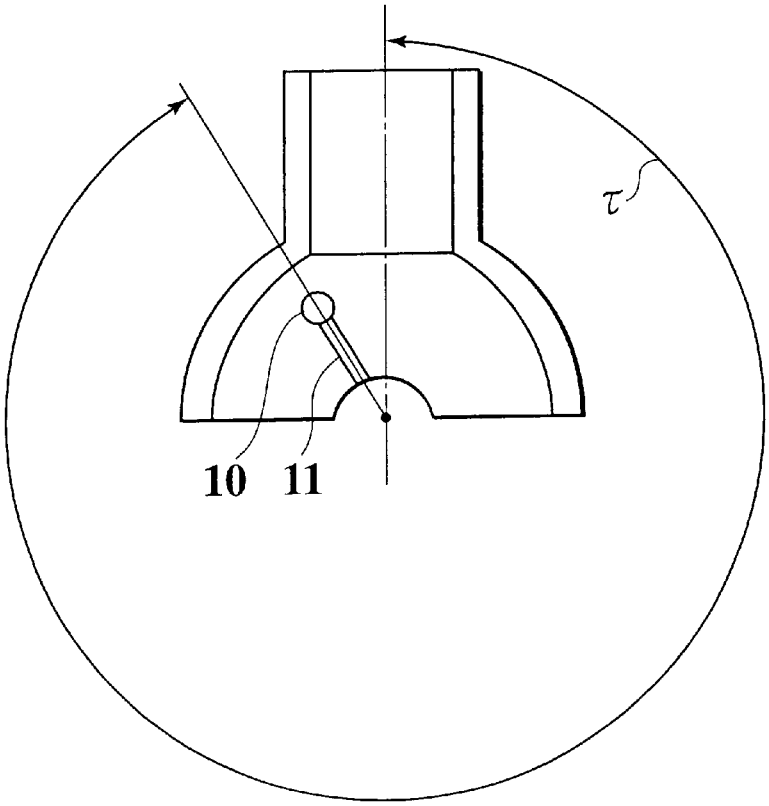
FIG. 5 is a schematic view showing a cylinder block of the embodiment of FIG. 2.

Also in this embodiment, by determining the respective positions of the oil holes on the ground of the above-mentioned expression defining the relationship of γ, α, β, τ, l and r (see FIGS. 3 to 5 ), the time when the position of the splash oil hole 15 coincides with the position of the oil hole 18 agrees with the time when the position of the oil hole 11 of the main journal 1 coincides with the position of the second oil hole 19 of the crankshaft 4, so that it can be obtained a condition that the main gallery 10 communicates with the splash oil hole 15, thereby performing operation and effect similar to those of the previous embodiment.

In common with the above-mentioned embodiments, owing to the provision of the single oil passage extending from the main gallery up to the splash oil hole through the intermediary of the main journal, the crankshaft and the crank pin in order, it is possible to remarkably increase the amount of lubricant ejected at the engine's rotation at low speed in the cold, whereby the reduction of piston slap can be improved remarkably.

The entire contents of Japanese Patent Application No. 10-250986 (filed on Sep. 4, 1998) is incorporated herein by reference.

Although the invention has been described above by reference to two embodiments of the invention, the invention is not limited to these embodiments described above. Modifications and variations of the embodiment described above will occur to those skilled in the art, in light of the above teachings.

The scope of the invention is defined with reference to the following claims.

What is claimed is:

1. A lubricating structure for an internal combustion engine, comprising:

a first oil hole formed in a main journal to communicate with a main gallery provided in a cylinder block;

a crankshaft having a second oil hole formed so as to communicate with the first oil hole of the main journal;

at least one crank pin formed on the crankshaft to rotate about a center of the crankshaft, the crank pin having a third oil hole formed for continuous communication with the second oil hole of the crank shaft;

a connecting-rod rotatably fitted on the crank pin and also provided, at a base part thereof, with a splash oil hole which is constructed so as to communicate with the third oil hole of the crank pin and which has an end opening at an inner face of a circular inner face of a bore for bearing the crank pin and the other end opening at the base part of the connecting-rod as an ejecting port for lubricating oil, wherein, when the splash oil hole is directed toward an inner peripheral face of a cylinder liner, the position of the first oil hole coincides with the position of the second oil hole, and the position of the splash oil hole coincides with the position of the third oil hole so as to form an oil passage for directly guiding oil from the main gallery to the splash oil hole.

2. The lubricating structure of claim 1, wherein the second oil hole is communicated with the third oil hole through a fourth oil hole which is formed in the crankshaft and the crank pin.

3. The lubricating structure of claim 2, wherein the second oil hole is formed in the crankshaft so as to pass in the vicinity of a rotational center axis of the crankshaft, while the third oil hole is formed in the crank pin so as to pass in the vicinity of a rotational center axis of the crank pin.

4. The lubricating structure of claim 3, wherein, the fourth oil hole has an end connected with the second oil hole in the vicinity of the rotational center axis of the crankshaft and the other end connected with the third oil hole in the vicinity of the rotational center axis of the crank pin, thereby providing a H-shaped configuration consisting of the second, third and fourth oil holes.

5. The lubricating structure of claim 1, wherein the second oil hole of the crankshaft is constituted by a first passage which communicates with the third oil hole of the crank pin in a straight manner and a second passage which has one end communicating with the first passage and the other end opening at the outer face of the crankshaft and also communicating with the first oil hole of the main journal.

6. The lubricating structure of claim 1, providing that, in view of the axial direction of the crankshaft, $\alpha$ represents an angle in a rotating direction of the crankshaft, the angle being made by both of an extension line on the side of the crank pin of a line linking a center of the crankshaft with a center of the crank pin and a line linking the center of the crank pin with an opening of the third oil hole opening at the outer face of the crank pin;

$\beta$ represents an angle between a center line of the connecting-rod and a line linking the center of the crank pin with the opening of the splash oil hole on the side of the inner face of the pin journal, in the opposite direction of the rotating direction of the crankshaft;

$\gamma$ represents an angle between the line linking the center of the crankshaft with the center of the crank pin center and a line linking the center of the crankshaft with an opening of the second oil hole opening at the outer face of the crankshaft, in the rotating direction of the crankshaft;

r represents a distance between the center of the crankshaft and the center of the crank pin;

l represents a distance between respective rotating centers on both sides of the connecting-rod; and $\tau$ represents an angle between a cylinder bore's center line passing through a center of the main journal and a line linking the center of the crankshaft with the opening of the first oil hole at the inner face of the main journal, in the rotating direction of the crankshaft, respective positions of the first, second and third oil holes and the splash oil hole are determined so as to meet a relationship of:

$$\gamma = \tau - \tan^{-1}\left\{\frac{-\sin(\alpha+\beta)}{(r/l)+\cos(\alpha+\beta)}\right\}.$$

* * * * *